US005088556A

United States Patent [19]

Short et al.

[11] Patent Number: 5,088,556

[45] Date of Patent: Feb. 18, 1992

[54] SUBSEA WELL GUIDE BASE RUNNING TOOL

[75] Inventors: David E. Short, Houston; William A. Valka, Spring, both of Tex.

[73] Assignee: FMC Corporation, Chicago, Ill.

[21] Appl. No.: 613,594

[22] Filed: Nov. 14, 1990

Related U.S. Application Data

[63] Continuation-in-part of Ser. No. 561,542, Aug. 1, 1990.

[51] Int. Cl.[5] ..... E21B 41/04

[52] U.S. Cl. ..... 166/339; 166/340; 166/351; 166/365

[58] Field of Search ..... 166/338–340, 166/342, 349, 351, 360, 365; 285/23, 39, 80, 86, 141, 317, 415, 419

[56] References Cited

U.S. PATENT DOCUMENTS

| | | | |
|---|---|---|---|
| 3,934,658 | 1/1976 | Nelson | 175/7 |
| 3,973,635 | 8/1976 | Gatlin et al. | 175/7 |
| 4,387,771 | 6/1983 | Jones | 166/349 X |
| 4,615,544 | 10/1986 | Baugh | 166/348 X |
| 4,832,124 | 5/1989 | Davis | 166/339 |
| 4,836,579 | 6/1989 | Wester et al. | 285/23 X |
| 4,880,061 | 11/1989 | Ahlstone | 166/348 |
| 4,881,850 | 11/1989 | Abreo | 166/338 X |
| 4,902,044 | 2/1990 | Williams et al. | 285/419 X |
| 4,927,295 | 5/1990 | Knowles | 166/349 X |
| 4,960,174 | 10/1990 | Rodrigues et al. | 166/365 X |

*Primary Examiner*—Ramon S. Britts
*Assistant Examiner*—Roger J. Schoeppel
*Attorney, Agent, or Firm*—W. William Ritt, Jr.; Richard B. Megley

[57] ABSTRACT

A running tool for use with a subsea well guide base when drilling from a floating drill ship is designed to be releasably detached without rotation so that the tool can be uncoupled at the surface upon completion of the guide base running procedure. The running tool is attached to the guide base by threaded elements which are designed to strip when a predetermined upward force is exerted on the running pipe string to which the tool is integrally connected thereby permitting retrieval of the tool by the running string.

8 Claims, 6 Drawing Sheets

48
52
75
68
70
68
66
72
46
54
74
64
50
92
62
62
92
60
58
58a
58a
36
90
56
36
90
56
50a
20
24
50a
22
24
32
22
26
26
34
28
28
30

SUBSEA WELL GUIDE BASE RUNNING TOOL

This application is a continuation-in-part of copending application Ser. No. 07/561,542, filed Aug. 1, 1990.

BACKGROUND OF THE INVENTION

When drilling oil and gas wells from a floating drilling rig, a structure called a permanent guide base is run (lowered) and landed on a temporary guide base that has been previously installed on the ocean floor at the subsea well site. To carry out this procedure the permanent guide base is releasably attached to a running tool that is connected to the bottom end of a string of pipe, and the pipe string and running tool are retrieved when the landing operation is completed.

SUMMARY OF THE INVENTION

The present invention comprises a running tool for a subsea well guide base, the tool including means to releasably attach it to the guide base so that the tool can be retrieved upon completion of the guide base running procedure. In its preferred embodiment the running tool is attached to the guide base by threaded elements, such as bolts or studs, that extend through a plurality of apertures in the tool and the guide base, and nuts or other elements threaded onto the bolts or studs. The nuts or other elements are designed to strip off the bolts or studs when a predetermined upward (lifting) force is exerted on the running pipe string to which the tool is connected, thereby releasing the tool from the guide base and permitting retrieval of the tool and running string.

DESCRIPTION OF THE ILLUSTRATED APPARATUS

FIGS. 1–7

Figure 1:
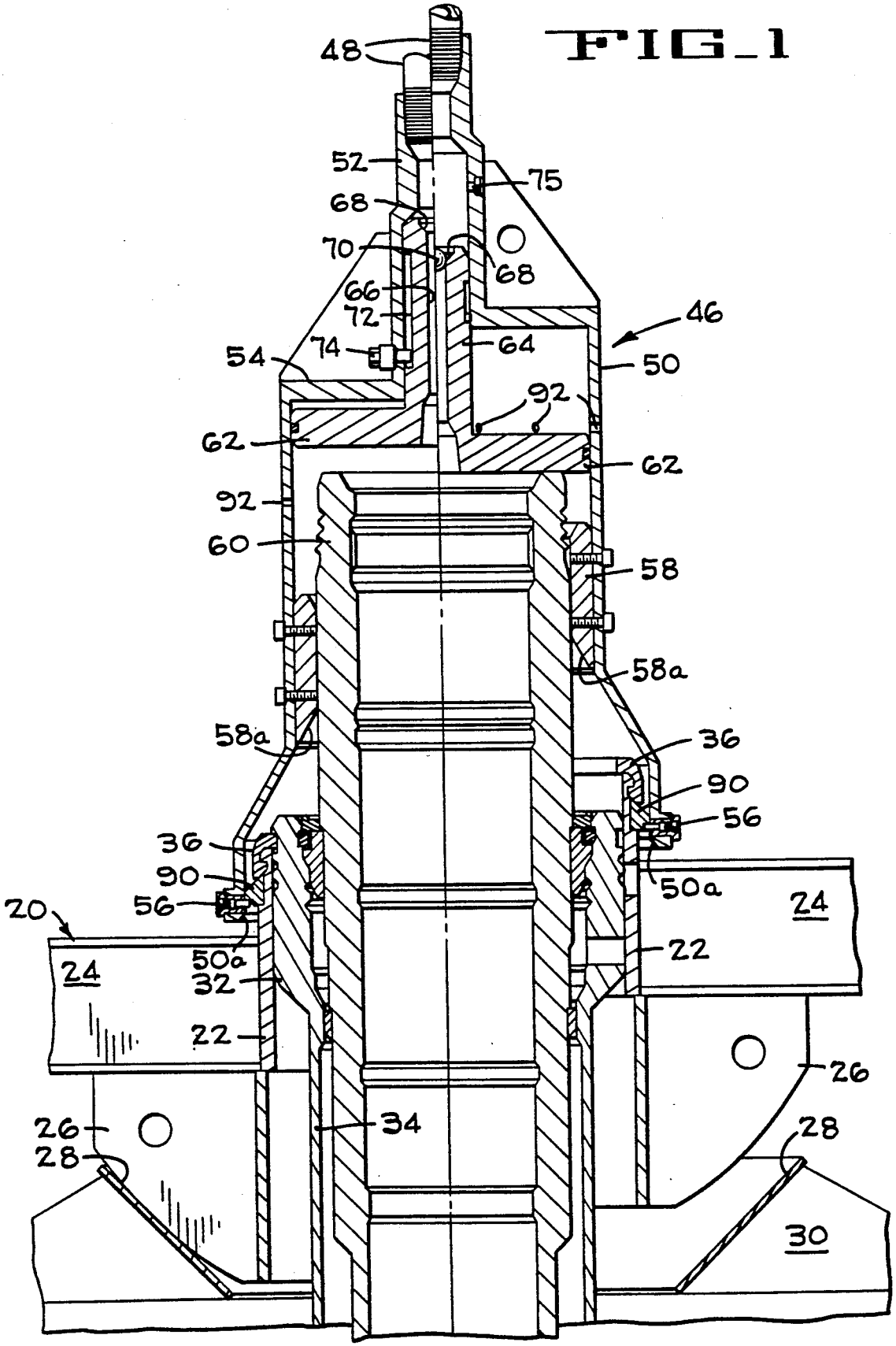
FIG. 1 is a central vertical section through two concentric subsea wellhead housings, a fragmentary permanent guide base, and a permanent guide base retrieval tool, showing in the left half the permanent guide base connected to the outer housing and the tool latched to the guide base, and in the right half the guide base released from the housing and lifted off the temporary guide base.

As seen best in FIG. 1, a retrievable permanent guide base 20, which can be run and landed by a running tool according to the present invention (FIGS. 8–11), comprises a central vertical tubular element 22, a plurality of horizontal struts 24 (only portions of two shown) radiating laterally from the central element 22 for supporting guide posts and other guide base elements (not shown) in the usual manner, and a gimbal section 26 that rests in an upward facing funnel 28 on a temporary guide base 30. During drilling operations the temporary guide base 30 is installed on the sea floor, a hole for a conductor pipe is drilled through the funnel 28, and then the permanent guide base 20, a conductor pipe housing 32 and a string of conductor pipe 34 are lowered as a unit from the drilling rig (not shown). The conductor pipe string is run into the well bore until the permanent guide base gimbal 26 lands on the temporary guide base funnel 28, whereby the funnel and temporary guide base support the conductor string and permanent guide base while that string is being cemented in place. The resulting cement foundation provides support for the conductor string and other strings of casing and tubing which are eventually run into the final wellbore, and also for the blowout preventer stacks (not shown) and the upward and sideward loads which are generated by a tensioned marine riser system (not shown).

Figure 2:
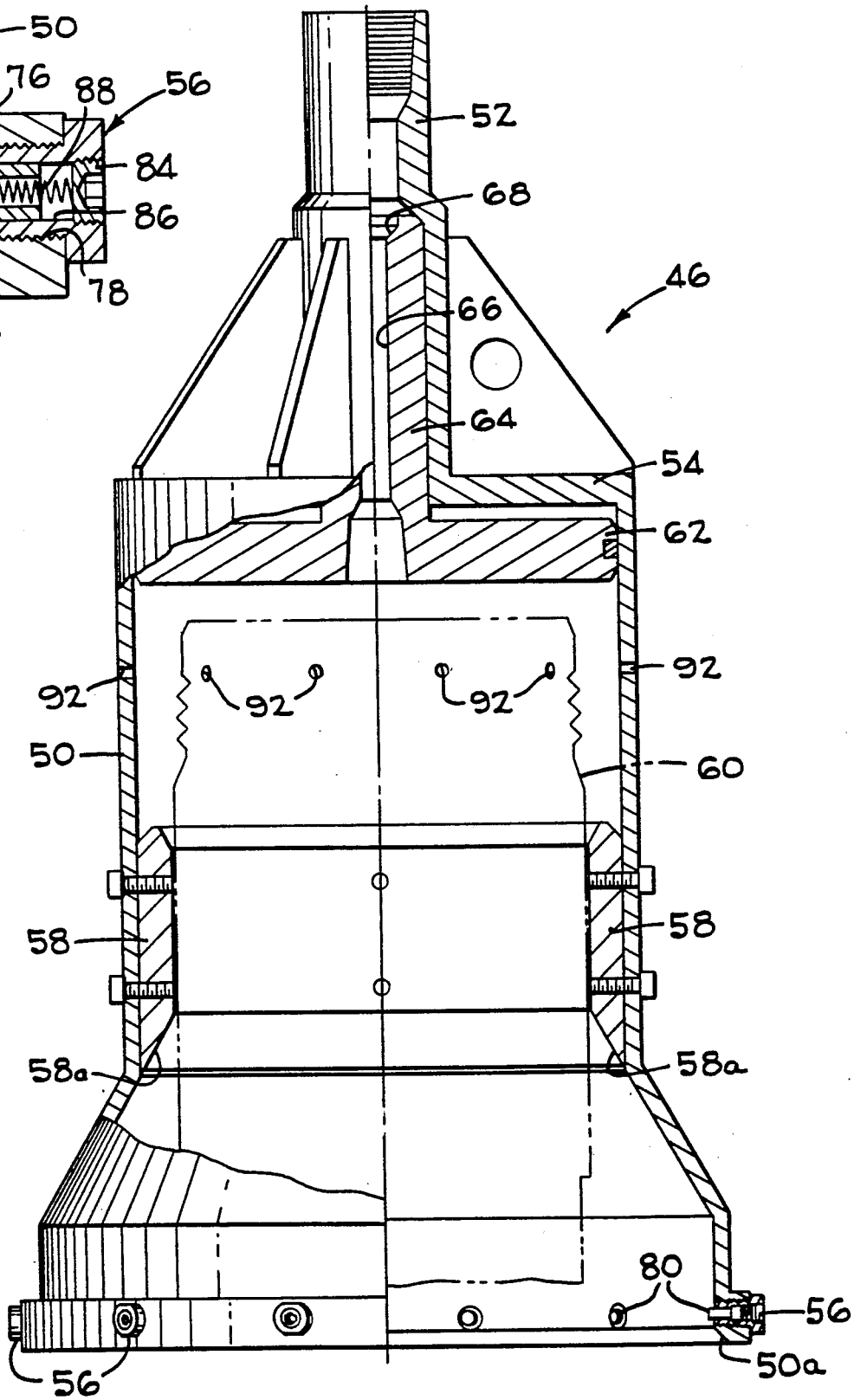
FIG. 2 is a front elevation of the retrieval tool of FIG. 1, on an enlarged scale and with some parts in vertical central section.
Figure 5:
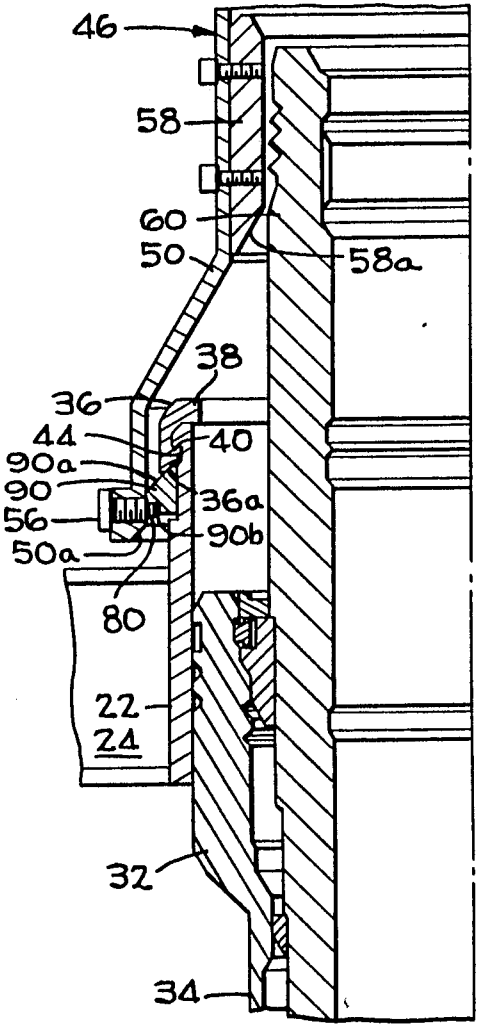
FIG. 5 is a view like FIGS. 3 and 4, but showing the guide base and retrieval tool lifted further with respect to the wellhead housing, and the locking ring in its contracted position on the guide base.

The permanent guide base 20 and the conductor pipe housing 32 are releasably connected together by an expandable split locking ring 36 (FIGS. 1 and 3) with upper and lower inward extending radial flanges 38, 40, the upper flange 38 residing in an annular groove 42 in the outer surface of the conductor housing 32, and the lower flange 40 residing in a annular groove 44 in the outer surface of the permanent guide base central element 22. When the ring 36 is in its functional position as shown in FIG. 3 and the left half of FIG. 2, it prevents relative axial movement between the permanent guide base 20 and housing 32, thereby serving to support the conductor housing in the permanent guide base while they are lowered and until the conductor pipe is cemented, and also to prevent upward movement of the permanent guide base, and structures attached to it, with respect to the conductor housing.

Figure 3:
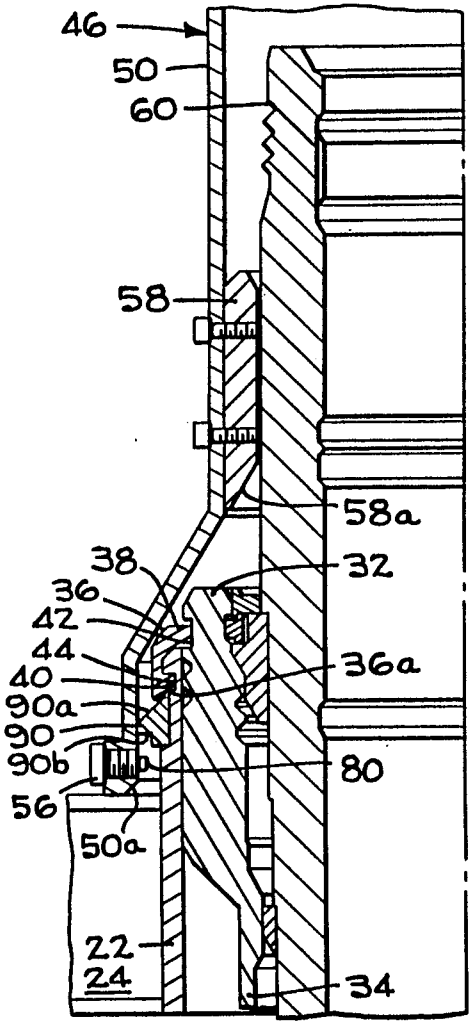
FIG. 3 is a fragmentary view, on an enlarged scale, of the wellhead housings, permanent guide base and retrieval tool of FIG. 2, showing the relative positions of the components just prior to commencement of the guide base releasing operation.

When retrieval of the permanent guide base 20 is desired, a retrieval tool 46 (FIGS. 1 and 2) is lowered from the floating drilling rig or other surface facility (not shown) on a pipe string 48 until it comes to rest on the base 20 as shown in FIG. 3. The retrieval tool 46 comprises a somewhat bell-shaped housing 50 with a central tubular extension 52 upstanding from its upper end wall 54, a plurality of circumferentially spaced retrieval pin assemblies 56 at its lower end portion, an adapter bushing 58 for use with an inner casing head or housing such as shown at 60, and a hydraulic piston 62 with a stem 64 that resides in the bore of the extension 52. The piston stem 64 has a central bore 66 with an annular seat 68 at its upper end to receive a ball 70 for closing the bore 66 when disengagement of the retrieval tool 46 from the permanent guide base 20 is desired. A longitudinal groove 72 in the outer surface of the piston stem 64 cooperates with a piston retainer, such as bolt 74, to retain the piston in place but permit its vertical movement with respect to the housing, and a shear pin 75 between the housing extension 52 and the piston stem 64 secures the piston in its upper position, as seen in the right half of FIG. 2, until it is sheared during the disengagement procedure.

Figure 6:
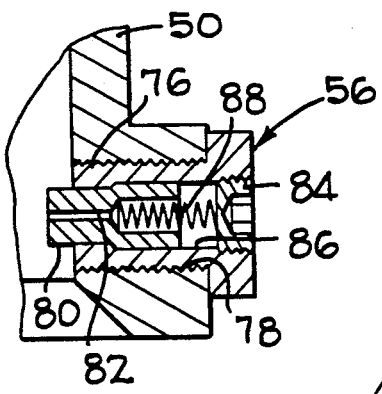
FIG. 6 is an enlarged fragmentary sectional view of one of the retrieval pin assemblies circumferentially spaced around the lower end of the retrieval tool of FIGS. 1–5.

As seen best in FIG. 6, each retrieval pin assembly 56 comprises an outer T-shaped sleeve 76 threaded to a radial port 78 in the housing 50, a tubular latch element 80 with a central pressure relieve bore 82, an end closure element 84 threaded into the outer end of the bore 86 in the sleeve 76, and a helical spring 88 extending between the closure element 84 and the latch element 80 that biases the latch element inward towards its ring-engaging position as shown in FIGS. 1–6.

Employing the retrieval tool 46 to release and retrieve the permanent guide base 20 from the conductor pipe housing 32 involves the following steps. With the tool connected to a pipe running string 48 and the piston 62 held in its upper position (left half of FIG. 1) by the shear pin 75, the tool is lowered toward the subsea well. Frusto-conical surfaces 50*a* on the lower edge of the tool housing 50 and 58*a* on the lower end of the adapter bushing 58 assist in guiding the tool 46 onto the conductor housing 32 and inner casing head 60, respectively. As the retrieval pin assemblies 56 approach the locking ring 36 any of the assembly latch elements 80 that contact the ring 36 are cammed outwardly against pressure of their springs 88 to permit further downward movement of the tool. In similar manner, as the latch elements 80 contact the frusto-conical surface 90*a* on the upper end of a ring 90 surrounding the conductor housing 32 beneath the locking ring 36 they are cammed outwardly to facilitate their downward movement past the ring 90 and further descent of the tool 46 to its final rest position on the guide base 20 (FIG. 3).

Figure 4:
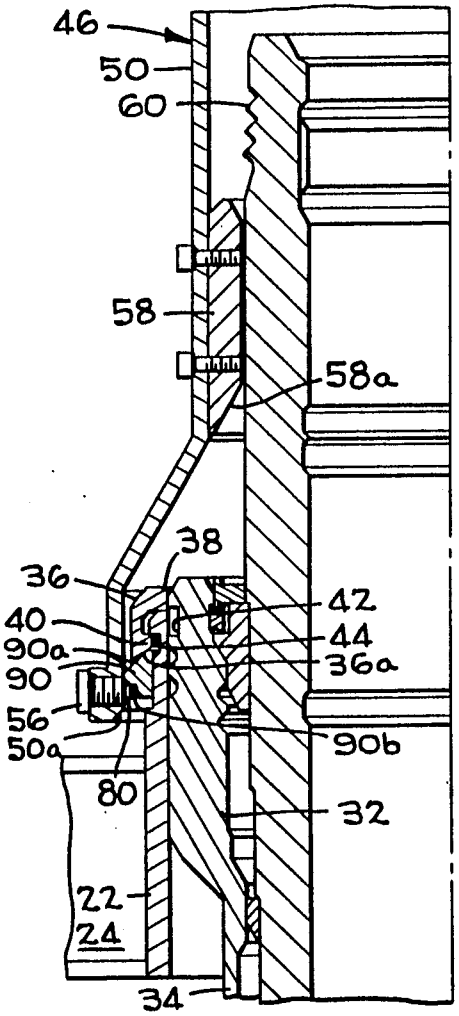
FIG. 4 is a view like FIG. 3, showing the locking ring and guide base released from the outer wellhead housing and partially lifted therefrom.

The retrieval tool 46 is then moved upward from its FIG. 3 position, either (1) by lifting the running string 48, (2) by dropping the ball 70 down the running string and onto its seat 68, and then hydraulically pressuring the piston 62 downward onto and against the upper end of the inner casing head 60 (right half of FIG. 1), or (3) by employing both methods (1) and (2) simultaneously. As the latch elements 80 of the retrieval pin assemblies 56 move upward they contact the lower radial surface 90*b* of the ring 90 and carry the ring upward also. As the ring 90 moves upward its frusto-conical surface 90*a* applies a camming force against the lower frusto-conical surface 36*a* of the locking ring 36, causing the locking ring to expand until its upper flange 38 has exited the groove 42 in the conductor housing 32. At this point the permanent guide base 20 is disengaged from the conductor housing 32 and begins its upward movement with the tool 46 (FIG. 4). As the locking ring upper flange 38 moves above the conductor housing 32 it contracts into its original locked position (FIG. 5) and remains therein during the rest of the lifting operation. Since the lower flange 40 of the locking ring is never expanded totally out of its groove 44 in the permanent guide base element 22, the tool 46 is always connected to the guide base 20 throughout its rise to the surface rig.

As the tool 46 is lifted to the surface a plurality of circumferential vent ports 92 in the upper end area of the housing 50 allow the seawater used in the running string 48 to exert hydraulic pressure on the piston, to drain from the string and the tool, thereby reducing the total weight to be lifted by the rig equipment and avoiding the need to drain the string and tool at the surface.

Figure 7:
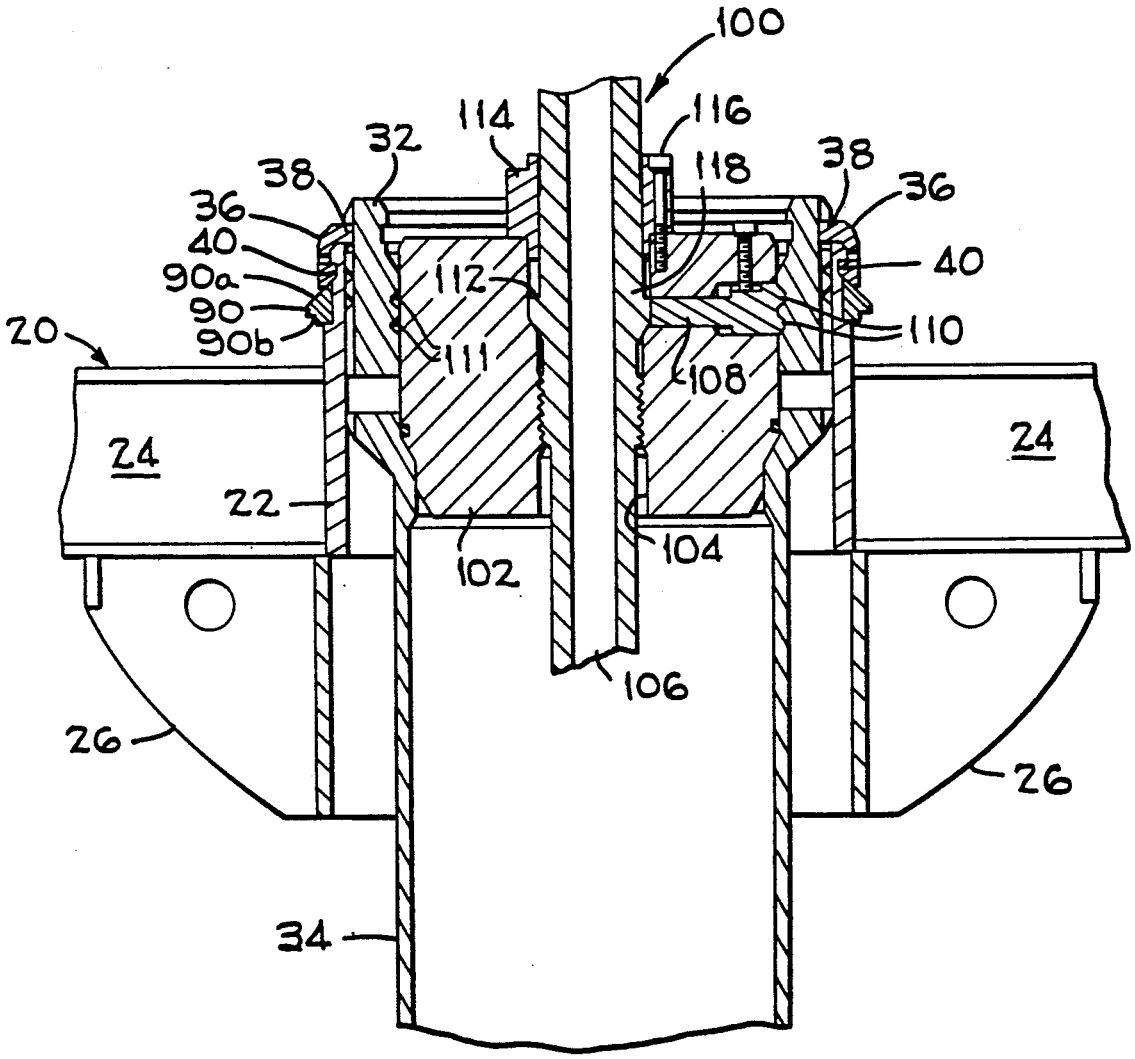
FIG. 7 is a fragmentary central sectional view of the permanent guide base, a conductor or other wellhead housing, and a wellhead running tool, with these components connected in preparation for running into a subsea well.

The permanent guide base 20 and the conductor head or housing 32, along with its attached conductor pipe string 34, can be run as a unit and installed in a subsea well by means of a running tool such as that illustrated at 100 in FIG. 7. The running tool 100 comprises a tool body 102 having a central bore 104 through which extends a pipe section 106 attached at its upper end to a pipe running string (not shown), and a radially oriented latch element 108 with external annular ribs 110 that reside in internal annular grooves 111 in the bore of the conductor housing 32 when the tool 100 is connected to the housing as seen in FIG. 7. After landing the permanent guide base 20 on the temporary guide base (not shown) at the well site and jetting in or otherwise installing the conductor pipe and cementing it in the well, the pipe element 206 is rotated with respect to the tool body 102 to unthread it upwardly until an annular shoulder 112 on the pipe element 106 contacts an annular stop element 114 surrounding the pipe element and secured to the upper end of the tool body, such as by cap screws 116 (only one shown). As an annular enlargement 118 of the pipe element 106 moves upward and out of position behind the latch element 108, that element is freed for axial inward movement out of the grooves 111, whereby lifting of the tool body 102 causes the latch element 108 to be cammed inwardly and release the tool for retrieval.

FIGS. 8–11 (Preferred Embodiment)

Figure 8:
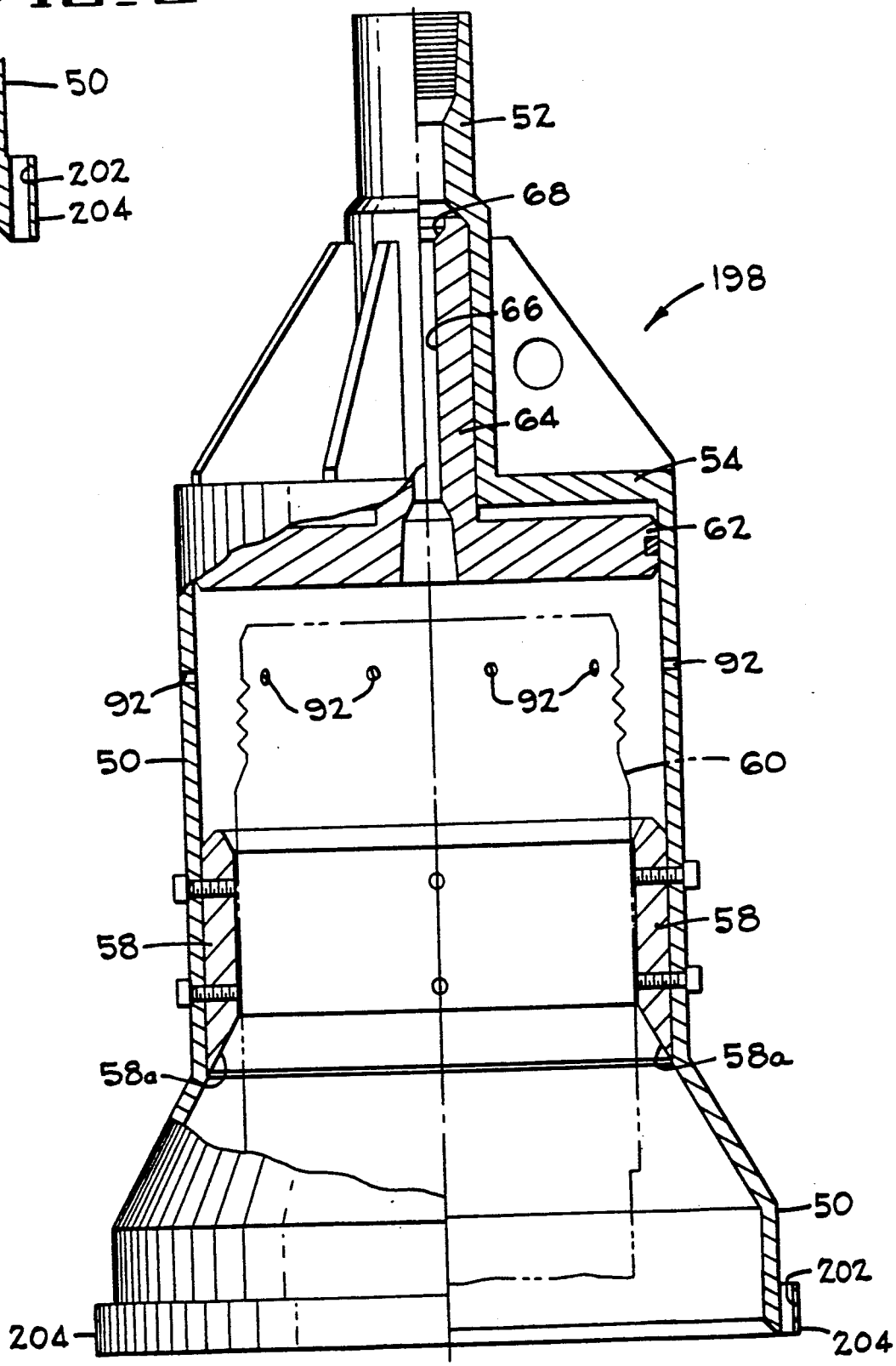
FIG. 8 is a view like FIG. 2, but illustrating a guide base running tool in accordance with the present invention.
Figure 10:
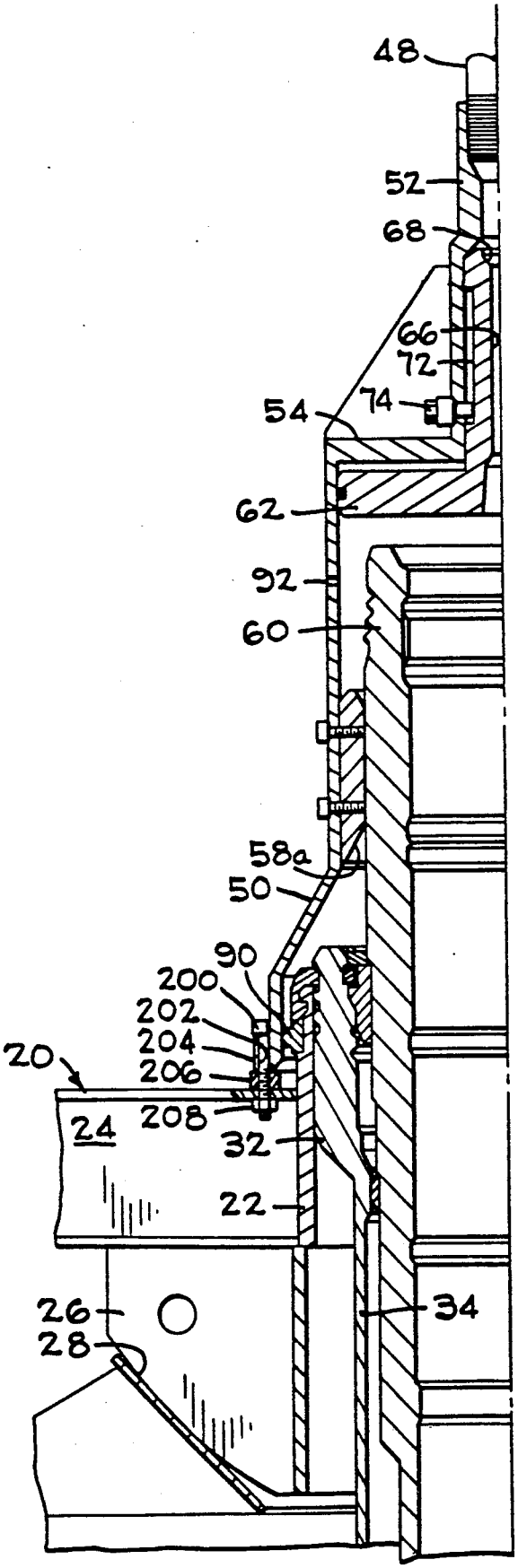
FIG. 10 is a view like the left half of FIG. 2, but showing the running tool of FIG. 8 attached to the permanent guide base.
Figure 11:
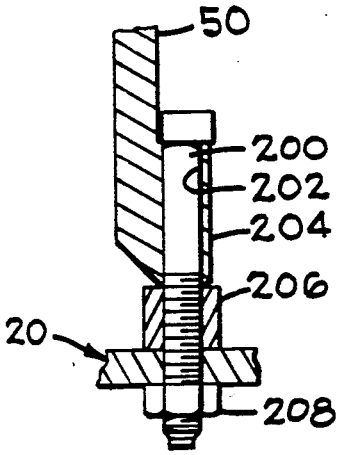
FIG. 11 is an enlarged fragmentary sectional view of a portion of the lower end of the running tool as attached to the permanent guide base in accordance with the present invention.

A guide base running tool in accordance with the present invention is illustrated at 198 in FIG. 8, and as will be apparent this tool 198 closely resembles the tool 46 described above in reference to FIGS. 1–6. In fact, many of the elements of the two tools 46, 198 are identical or nearly so, and for that reason the same reference numerals are used for those elements in both tools.

Figure 9:
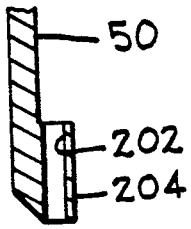
FIG. 9 is an enlarged fragmentary sectional view of a portion of the lower end of the running tool of FIG. 8.

As seen best in FIGS. 8 and 9, the lower end portion of the housing 50 of the running tool 198 includes a circumferential flange 204 with a plurality of circumferentially spaced axial apertures or bores 202 for receiving a like plurality of rod-like elements such as bolts or studs 200 (FIGS. 10 and 11) that provide a means of attaching the running tool 198 to the permanent guide base 20. As seen best in FIG. 11, the bolts or studs 200 extend downwardly through the adjacent strut of the guide base 20 and are held in place by nuts 208. Depending upon the dimensions and desired positioning of the running tool 198 with respect to the wellhead components and the guide base, a plurality of spacers 206 of appropriate length can be employed with the bolts or studs 200 to assure proper spacing of the tool from the base.

The nuts 208 are designed to strip off the threaded portions of the bolts or studs 200 upon exertion of a predetermined vertical force on the running tool 198, such as by lifting of the running string 48, whereby the running tool separates from the guide base. As the tool 198 rises from the guide base 20 it clears and thus does not actuate the ring 90, so that the guide base remains connected to the conductor head or housing 32 by means of the locking ring 36.

When the running tool 198 is employed to run a guide base onto a subsea well in which an inner casing head 60 has previously been installed, the tool 198 can be separated from the guide base by application of hydraulic pressure through the running string 48 to force the piston 62 down onto the top of the head 60, as explained above with respect to the retrieval tool 46. Furthermore, application of both a lifting force on the running string 48 and hydraulic pressure through that string can be used to disengage the tool 198 for retrieval.

Although the best mode contemplated for carrying out the present invention has been herein shown and described, it will be apparent that modification and variation may be made without departing from what is regarded to be the subject matter of the invention.

What is claimed is:

1. A running tool for a subsea well guide base, said tool comprising a) a generally bell-shaped housing with means for integral attachment to a pipe string, said housing including a circumferential flange with a plurality of generally parallel axial bores;

b) means for releasably attaching said housing to a subsea well guide base, said releasably attaching means including (i) corresponding generally parallel bores in said guide base, (ii) rod-like elements extending through the bores in said housing and into said corresponding bores in said guide base, and (iii) means to secure said rod-like elements to said guide base and to release said elements from said base upon exertion solely of a predetermined non-rotational lifting force on said elements; and c) means to lift the housing with respect to the guide base to disengage said housing from said base.

2. A running tool according to claim 1 wherein the rod-like elements include threads that releasably engage the element securing means.

3. A running tool according to claim 2 wherein the rod-like elements are bolts.

4. A running tool according to claim 2 wherein the rod-like elements are studs.

5. A running tool according to claim 2 wherein the element securing means are threaded nuts.

6. A running tool according to claim 5 wherein the nut threads are designed to strip and release their engagement with the rod-like elements in response to said predetermined axial force.

7. A running tool according to claim 1 wherein the rod-like elements comprise threaded bolts, and the element securing means comprise threaded nuts.

8. A running tool according to claim 7 wherein the bolts are designed to strip out of the nuts in response to said predetermined axial force.

* * * * *